United States Patent [19]

Enkvist

[11] Patent Number: 4,722,213

[45] Date of Patent: Feb. 2, 1988

[54] METHOD AND APPARATUS FOR THE PRODUCTION OF BENT TUBES

[75] Inventor: S. H. Göthe Enkvist, Fagersta, Sweden

[73] Assignee: Santrade Ltd., Lucerne, Sweden

[21] Appl. No.: 9,006

[22] Filed: Jan. 28, 1987

Related U.S. Application Data

[63] Continuation of Ser. No. 694,339, Jan. 24, 1985, abandoned, which is a continuation-in-part of Ser. No. 441,523, Nov. 5, 1982, abandoned.

[30] Foreign Application Priority Data

Mar. 13, 1981 [SE] Sweden ..... 8101609
Sep. 15, 1981 [SE] Sweden ..... 8105474

[51] Int. Cl.[4] ..... B21C 1/24

[52] U.S. Cl. ..... 72/285; 72/283; 72/370

[58] Field of Search ..... 72/276, 283, 277, 285, 72/287, 290, 274, 369, 370; 29/157 A

[56] References Cited

U.S. PATENT DOCUMENTS

| | | | |
|---|---|---|---|
| 537,453 | 4/1895 | Hewlett | 72/285 |
| 717,178 | 12/1902 | Earle | 72/285 |
| 718,671 | 1/1903 | Stiefel et al. | 72/283 |
| 799,501 | 9/1905 | Thompson | 72/285 |
| 1,178,331 | 4/1916 | Marvin | 72/285 |
| 1,478,480 | 12/1923 | Lowe . | |
| 2,435,904 | 2/1948 | Robaus | 29/157 A |
| 2,716,482 | 8/1955 | Schweich et al. | 72/285 |
| 2,717,072 | 9/1955 | Andrews et al. | 72/283 |
| 2,996,100 | 8/1961 | Newhall et al. | 72/369 |
| 3,013,652 | 12/1961 | Russell | 72/283 |
| 3,602,030 | 8/1971 | Noda et al. | 72/370 |
| 3,646,799 | 3/1972 | Kipp et al. | 72/370 |
| 4,161,112 | 7/1979 | Stump | 72/283 |

FOREIGN PATENT DOCUMENTS

| | | | |
|---|---|---|---|
| 671531 | 2/1939 | Fed. Rep. of Germany | 72/287 |
| 1062528 | 7/1959 | Fed. Rep. of Germany . | |
| 2154226 | 5/1973 | Fed. Rep. of Germany . | |
| 2445945 | 4/1976 | Fed. Rep. of Germany | 72/285 |
| 568250 | 3/1924 | France | 72/283 |
| 1067274 | 6/1954 | France | 72/285 |
| 2449488 | 10/1980 | France | 72/285 |

OTHER PUBLICATIONS

Enkvist, Gothe, "Method and Apparatus for Production of Tubes, and Resulting Product," PCT/SE82/00064, Sep., 1982.

*Primary Examiner*—Daniel C. Crane
*Attorney, Agent, or Firm*—Burns, Doane, Swecker & Mathis

[57] ABSTRACT

A bent tube is formed by passing a straight tube through a diameter-reducing die such that the central axis of the die forms an acute angle with the direction by which the tube is pulled through the die. The acute angle can be kept constant in order to produce a tube having a constant radius of curvature. Alternatively, the acute angle can be changed during the drawing process to form the tube with a radius of curvature which varies along the tube length.

9 Claims, 6 Drawing Figures

METHOD AND APPARATUS FOR THE PRODUCTION OF BENT TUBES

This is a continuation of U.S. Ser. No. 694,339 filed Jan. 24, 1985, now abandoned, which is a continuation-in-part of U.S. Ser. No. 441,523 filed Nov. 5, 1982, now abandoned.

BACKGROUND AND OBJECTS OF THE INVENTION

The present invention relates to a method for producing bent tubes with a predetermined curved form by a cold drawing operation in which a hollow tube blank has its outer diameter and wall thickness reduced, and an apparatus for carrying out the method.

It is previously known to produce bent tubes, for use as casting moulds, by the drawing of hollow tube blanks but the known methods have generally turned out to be slow and expensive and they have limited the choice of tube material and wall thickness. In many instances the known methods involve uneven quality with undesirable variations in the wall thickness of the tube. Especially in utilizing a bent mandrel, which is inserted into the blank before the drawing operation and is removed after the drawing operation, it has been noticed that the inner surface of the tube has been damaged in connection with the relative motion between the bent mandrel and the tube blank.

The purpose of the present invention is to overcome these inconveniences in the production of tubes by cold drawing over a mandrel.

A further object is to provide a technique which eliminates the disadvantages which are related to bent moulds having a constant radius of curvature, i.e., when such moulds are used for continuous casting relative to the increasing curvature of the cast material when cooled, the cast material will not be in continuous contact with the mould wall.

SUMMARY OF THE INVENTION

In accordance with the present invention, the final curved form of the tube can be obtained in one single drawing operation utilizing one single drawing die. This is accomplished by drawing the tube blank (made in a known way, per se), through an annulus between a drawing die and an internal mandrel which is short relative to the tube blank. The tube is passed through the die in such a manner that the central axis of the die forms an acute angle with the direction in which the tube is pulled through the die. This inherently produces a tube having a radius of curvature. A curved support surface is disposed at the exit end of the die; the bent tube slides along that surface in order to prevent deformation of the tube.

The acute angle can be kept constant during the drawing operation to produce a constant radius of curvature. The acute angle can, instead, be changed during the drawing process in order to vary the radius of curvature of the tube along its length.

THE DRAWING

The objects and advantages of the invention will become apparent from the following detailed description of preferred embodiments thereof in connection with the accompanying drawing in which like numerals designate like elements, and in which.

DETAILED DESCRIPTION OF PREFERRED EMBODIMENTS OF THE INVENTION

Figure 1:
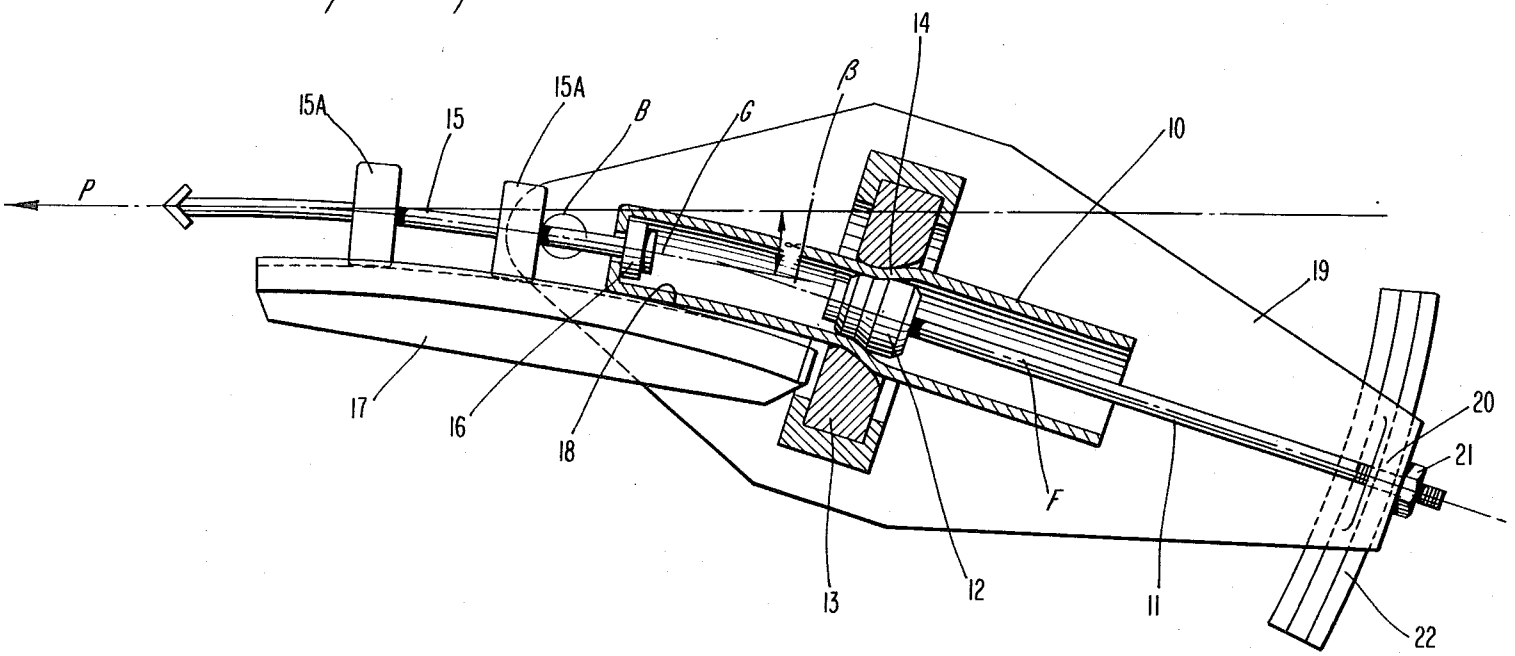
FIG. 1 is a schematic side elevational view depicting a tube being cold-drawn through a die in accordance with the present invention.

In the method for cold drawing of tubes according to the invention, a straight tube blank 10 (made in a known way) is reduced by cold drawing the blank through an annulus which is formed between a drawing die 13 and an internal straight mandrel 12. The mandrel, which is carried by a rod 11, is inserted into the tube, the length of the mandrel 12 being short relative to that of the tube blank. The approach zone of the drawing die 13 is convergent in the drawing direction in a conventional way.

Between the inner surface of the tube blank 10 and the mandrel 12 a clearance 14 is formed of such a size that the mandrel can be conveniently inserted into the tube blank 10. In the drawing operation, lubricant is supplied between the tube and the drawing die 13 as well as between the mandrel 12 and the tube 10. The dimension of the mandrel 12 corresponds to the desired inner dimension of the final tube. During the drawing of the tube 10 over the mandrel 12, the latter is principally stationary relative to the tube. Alternatively, in certain cases the reversed procedure may be possible, i.e., stationary tube and movable drawing tool.

After coming out of the drawing die 13 the tube 10 has its desired final dimension in accordance with the following procedure. The tube 10 is drawn through the die 13 such that the central axis G of the exiting tube 10 forms an acute angle $\beta$ with the central axis F of the die. As a result of the angular relationship existing between those axes, the tube is bent, i.e., is formed with a radius of curvature, in response to passing through the die. That is, if the axes F and G mutually coincided, the tube would not be formed with a radius of curvature. The bending of the tube is an inherent consequence of the angling of the axes F and G relative to one another.

In order to pull the tube through the die, a device comprising a drawing rod 15 with an annular plate 16 at its end is applied to the front end of the tube (i.e., the end having passed the exit of the drawing die 13 in FIG. 1). A force P is applied by the rod 15, drawing the tube 10 along a predetermined curved surface 18, against which the outer surface of the tube 10 slides. As noted above, a preset angle $\beta$ between the central axis F of the drawing die 13 and the central axis G of the exiting tube 10 causes the tube to assume a constant radius of curvature.

Figure 4:
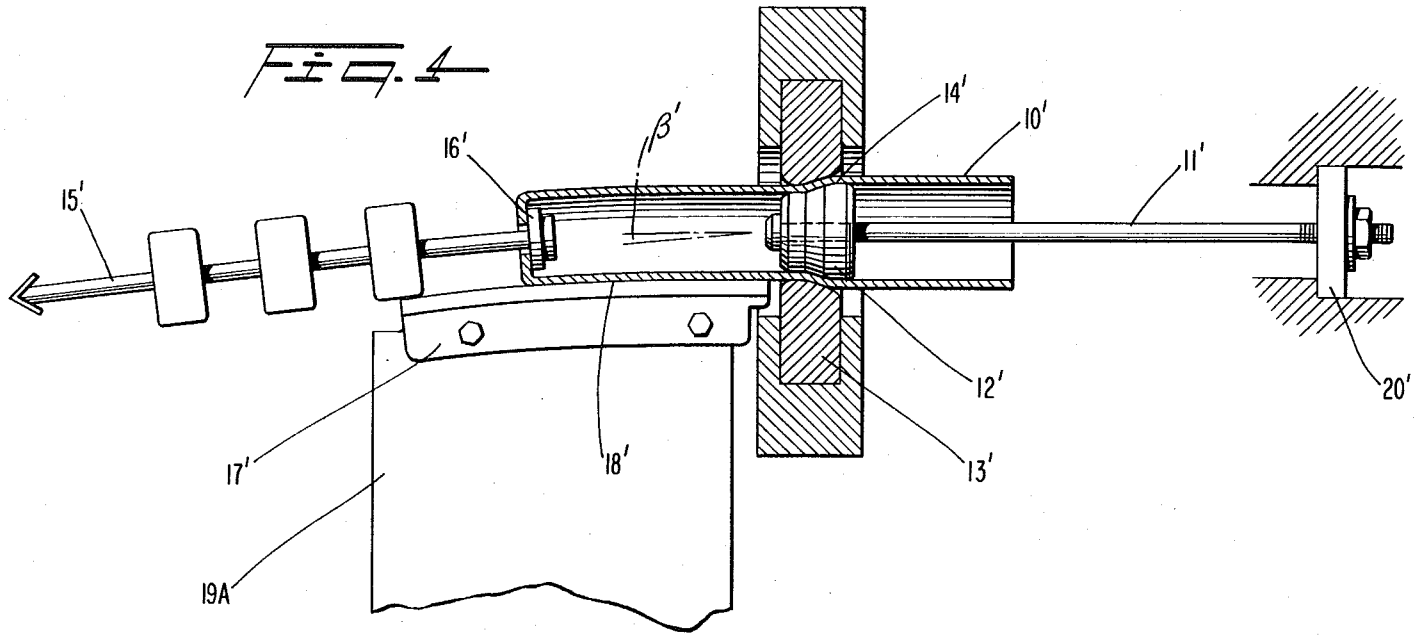
FIG. 4 is a view similar to FIG. 2 of an alternative tube drawing arrangement.

A suitable embodiment according to the invention in the forming of a tube with a radius of curvature of about 6m involves a preset angle $\beta$ of about 9 degrees, which radius of curvature is maintained by the supporting surface 18. That is, deformation of the tube downstream of the die is prevented by the supportiveness of the surface 18. The guiding device 17 can be suitably fixedly attached to a stand 19 which carries the die 13 and rod 11 (the rod 11 being secured against axial movement by a nut 21), or it can be suitably attached to another frame member 19A as depicted in FIG. 4). However, in the case where the stand is to be rotated to produce a tube having a varying (non-constant) radius of curvature, it is preferable that the guiding device 17 be attached to the stand 19, and that the stand 19 be mounted for movement, as will be explained subsequently.

It is preferable that the guiding device 17 is formed with a surface 18 having an elliptical surface (i.e., non-constant radius) and that the device 17 be adjustable relative to the stand 19 so that the angle $\beta$ can be adjusted in order to change the constant radius of curvature being formed in subsequent tubes. Adjustment of the angle $\beta$ can be facilitated by mounting one end of the stand 19 for adjustable movement in a guide track 22 with suitable means (not shown) being provided to hold the stand in various positions of adjustment. The other end of the stand can be rotatably carried by a pivot pin B which is attached to a stationary framework. It may also be desirable in such a case to mount the device 17 for adjustment relative to the stand 19 to present a different portion of the surace 18 as the guiding surface, whereby the guide surface can conform more closely to the newly adjusted radius of curvature.

The rod 15 may have guide blocks 15A attached thereto which slide along the guide surface 18 (two guide blocks 15A are depicted in FIG. 1 although any number may be employed (see FIG. 3)).

Figure 2:
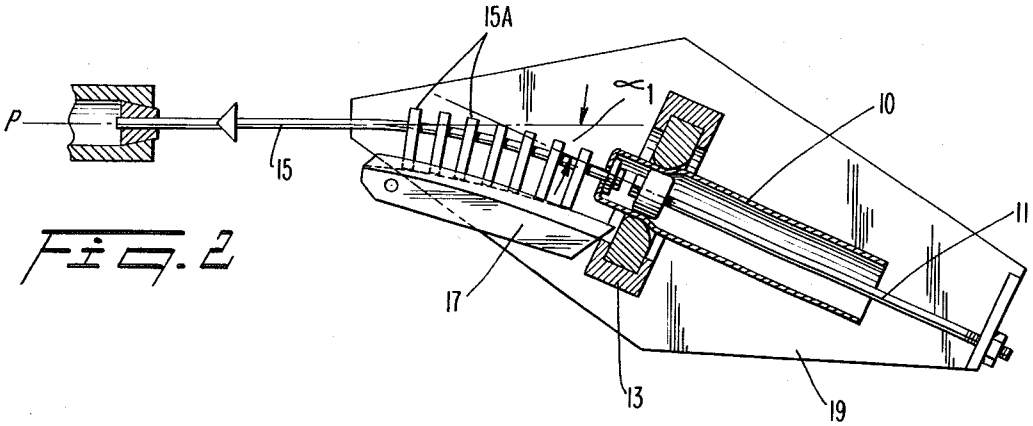
FIGS. 2 and 3 are views similar to FIG. 1 depicting the tube at the beginning and end, respectively, of the drawing operation.
Figure 3:
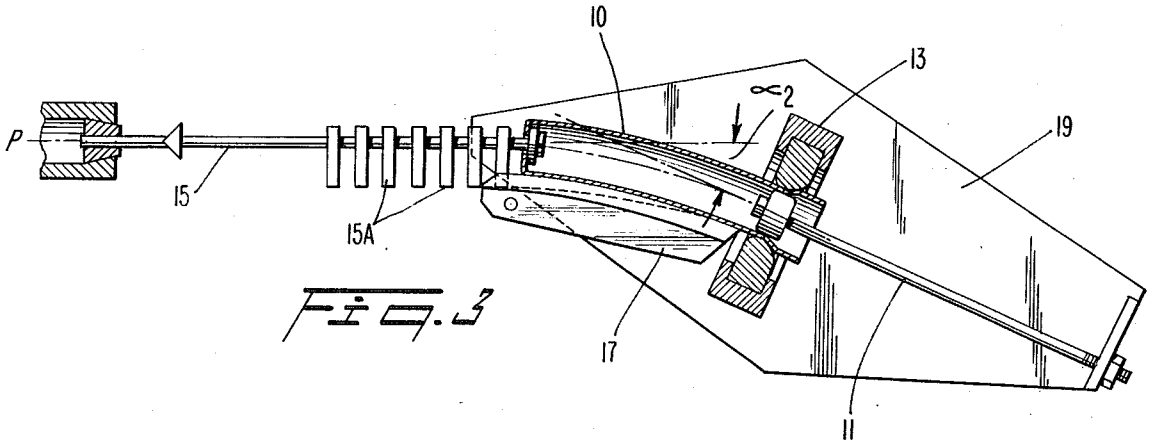

A drawing procedure is depicted in FIGS. 2 and 3 wherein the progression of the tube 10 through the die 13 is depicted. No track 22 or pivot B is employed. The tube is formed with a constant radius of curvature, i.e., the angle $\beta$ is kept constant. Also the angle $\alpha$ formed by the direction of the force P and the central axis F of the die 13 (which axis F coincides with the direction of entry of the tube 10 into the die), is kept constant.

In FIG. 4, an alternative arrangement is depicted wherein the rod 11' which carries the mandrel 12' is mounted in a plate 20' which is affixed to a stationary frame. A guide device 17' having a curved surface 18' is carried by a stationary frame 19A. A pull rod 15' carries a plate 16' disposed within the tube to pull the tube 10' through the stationary die 13' so that an acute angle $\beta'$ is formed between the central axis of the die and the direction at which the tube 10' exits the die.

Figure 5:
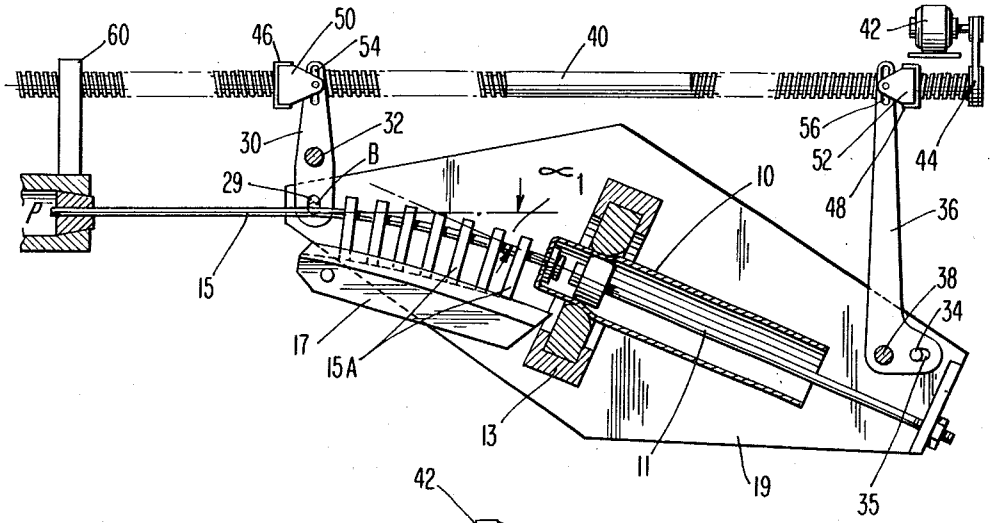
FIGS. 5 and 6 are schematic side elevational views of another embodiment of the invention at the beginning and end, respectively, of the drawing operation.
Figure 6:
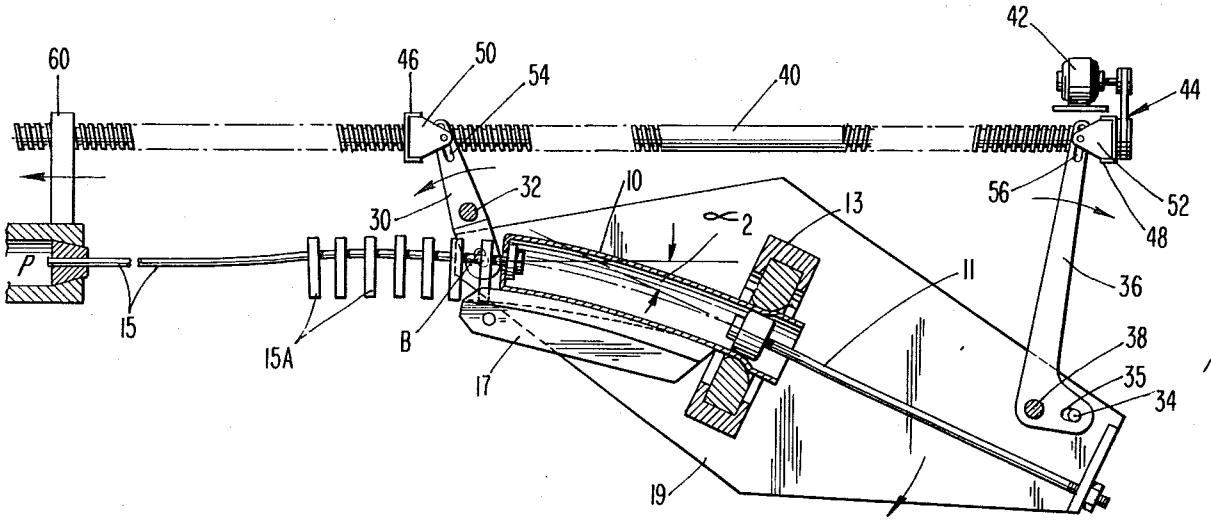

In accordance with the present invention it is possible to form the tube 10 with a radius of curvature which varies along its length (rather than having a constant radius). In that regard, the stand 19 and die 13 are mounted so as to be turnable about a pivot point during the drawing operation. As depicted in FIGS. 5 and 6, the die 13 is mounted on the stand 19 and the stand is mounted for rotation on a pivot pin B. The pivot pin B is carried in a slot 29 at the lower end of a first crank arm 30, the crank arm being mounted for rotation about a fixed axle 32 which is mounted to a stationary frame (not shown).

A rear end of the stand 19 carries a pin 34 which is disposed within a slot 35 in a lower end of a second crank arm 36. The second crank arm 34 is mounted for rotation about a fixed axle 38 which is mounted to the above-mentioned frame (not shown). The upper ends of the first and second crank arms 30, 36 are arranged to be displaced in a linear direction. For that purpose a threaded drive shaft 40 is arranged adjacent to the stand and is driven rotatably about its longitudinal axis by a motor 42 and belt and pulley mechanism 44. Attached to the shaft 40 are first and second threaded nuts 46, 48 which have first and second flanges 50, 52 projecting therefrom. Those flanges carry pins which are received in slots 54, 56 in the upper ends of the crank arms 30, 36, respectively. As the motor 42 rotates the shaft 40, the nuts and flanges 50, 52 are linearly displaced along the shaft, whereby the crank arms are rotated about their axes 32, 38 and thereby displace the associated ends of the stand 19. In the preferred embodiment the shaft 40 contains sections of reversely pitched threads for the nuts 46, 48, whereby those nuts travel in opposite directions in response to rotation of the shaft 40. Thus, as can be seen in FIG. 6, rotation of the shaft 40 in one direction causes the front (left end) of the stand to be raised and the rear (right end) to be lowered.

A bar 60 has a threaded upper end threadedly mounted on the shaft 40, and a lower end attached to the rod 15. As the shaft rotates in the above-mentioned one direction, the bar forces the rod 15 forwardly (to the left in FIG. 1) to pull the tube through the die. This is achieved whereby the direction of travel of the tube through the die forms an acute angle with the axis of the die so as to impart a curvature to the tube as it passes through the die, as explained earlier herein.

An alternative way of rotating the stand is to mount the front end of the stand pivotably at B, and mount the rear end of the stand for travel along a track similar to the track 22 of FIG. 1 (i.e., the crank arms 30, 36 would be eliminated). It has been found that the pulling forces from the rod 15 which pull the tube through the die will cause the stand to rotate about the pivot B.

Regardless of which method is employed to rotate the stand, such rotation results in the rod 11, mandrel 12 and the drawing die 13 being turned so that the angle $\beta$ (defined previously as the angle between the central axis of the tube 10 entering the drawing die 13 and the direction of the drawing force P), is gradually decreased with respect to its initial value. Hence, it is possible to make tubes with variable radius of curvature, adapted to every purpose. The technical effect is that tubes intended for moulds now can get a variable radius of curvature along their longitudinal direction. Thus, the radius of curvature can be adjusted to the curvature of the cooled cast material in order to obtain a better contact between the cast material and the mould wall, hence improving the cooling.

The bent tube also has an excellent inner surface smoothness. Further, the inner surface of tubes intended for moulds may have a wear resistant coating, e.g., chromium plating. The bent tube preferably intended for moulds is especially characterized in that its radius of curvature varies along its longitudinal direction. Further, it has preferably a uniform wall thickness.

According to the embodiment shown in FIGS. 1 and 4, the mandrel 12 is shaped with a cross-section partly decreasingly tapered in the drawing direction. It is hereby possible to change the inner dimension of the final tube by a certain axial displacement of the mandrel in the drawing direction during the drawing operation.

The described technique for drawing of tubes can be applied to tubes of different forms, such as circular, rectangular, square or the like. The technique is also applicable to cold drawing of different types of plastically deformable metallic material, such as steel, copper or the like.

Although the present invention has been described in connection with preferred embodiments thereof, it will be appreciated by those skilled in the art that additions, modifications, substitutions, and deletions not specifically described, may be made, without departing from the spirit and scope of the invention as defined in the appended claims.

What is claimed is:

1. A method of cold drawing a metal tube comprising the steps of:

arranging within the die a mandrel having a length which is short relative to the tube length, spacing the mandrel from the die to define a clearance therebetween which is of smaller diameter than said tube, cold drawing the tube through the clearance in a direction such that a longitudinal axis of the tube exiting said die forms an acute angle relative to a longitudinal axis defined by said die, and changing said acute angle as said tube is being drawn.

2. A method of cold drawing a metal tube comprising the steps of:

arranging within the die a mandrel having a length which is short relative to the tube length, spacing the mandrel from the die to define a clearance therebetween which is of smaller diameter than said tube, and cold drawing the tube through the clearance in a direction such that a longitudinal axis of the tube exiting said die forms an acute angle relative to a longitudinal axis defined by said die, said cold drawing step including applying an external force to a rod arranged inside the tube to pull said tube through said clearance, a plurality of guide blocks carried by said rod, said guide blocks sliding along a curved surface disposed adjacent said die, causing said mandrel and die to turn about a pivot during said cold drawing step.

3. A method of cold drawing a metal tube comprising the steps of:

arranging within the die a mandrel having a length which is short relative to the tube length, spacing the mandrel from the die to define a clearance therebetween which is of smaller diameter than said tube, and cold drawing the tube through the clearance in a direction such that a longitudinal axis of the tube exiting said die forms an acute angle relative to a longitudinal axis defined by said die, and turning the drawing die as the tube is being drawn, whereby said angle is gradually decreased.

4. A method of cold drawing a metal tube comprising the steps of:

arranging within the die a mandrel having a length which is short relative to the tube length, spacing the mandrel from the die to define a clearance therebetween which is of smaller diameter than said tube, cold drawing the tube through the clearance in a direction such that a longitudinal axis of the tube exiting said die forms an acute angle relative to a longitudinal axis defined by said die, and sliding said tube along a curved support surface located at an outlet end of said die.

5. A method according to claim 4, including the step of maintaining said acute angle constant during said cold drawing step.

6. A method according to claim 4, including the step of arranging a mandrel inside the tube blank prior to said cold drawing step, said mandrel being shaped with a cross-section partly decreasingly tapered in the drawing direction, displacing said mandrel a certain axial distance forwards in the drawing direction during the drawing operation.

7. Apparatus for cold drawing metal tubes comprising a drawing die with an approach zone convergent in the drawing direction, said die defining a longitudinal axis, an internal mandrel, the length of said mandrel being short relative to that of the tube, said mandrel having a dimension corresponding to that desired for the final tube, drawing means for drawing the tube through said die in a direction oriented at an acute angle relative to said longitudinal axis of said die so that a longitudinal axis of the tube exiting said die forms an acute angle with said longitudinal axis defined by said die, said die mounted for rotation about a pivot axis, and means for rotating said die about said pivot axis for changing said acute angle during said drawing operation.

8. Apparatus for cold drawing metal tubes comprising a drawing die with an approach zone convergent in the drawing direction, said die defining a longitudinal axis, an internal mandrel, the length of said mandrel being short relative to that of the tube, said mandrel having a dimension corresponding to that desired for the final tube, drawing means for drawing the tube through said die in a direction oriented at an acute angle relative to said longitudinal axis of said die so that a longitudinal axis of the tube exiting said die forms an acute angle with said longitudinal axis defined by said die, said drawing means comprising a rod having a tube attachment end for pulling the tube, guide means carried by said rod, and means defining a guide surface at a tube outlet end of said die along which said guide means travels, said guide surface oriented at an acute angle relative to said longitudinal axis of said die for guiding said rod in said direction.

9. Apparatus according to claim 8, wherein said guide surface is curved.

* * * * *